US005095830A

United States Patent [19]

Love

[11] Patent Number: 5,095,830

[45] Date of Patent: Mar. 17, 1992

[54] MEANS FOR MOUNTING AN ADJUSTABLE EMBOSSING DIE

[75] Inventor: Marc C. Love, Goshen, Ind.

[73] Assignee: Atlas Die, Inc., Elkhart, Ind.

[21] Appl. No.: 573,379

[22] Filed: Aug. 24, 1990

[51] Int. Cl.[5] ..... B31F 1/07

[52] U.S. Cl. ..... 101/28; 101/390; 101/393; 101/394; 403/297

[58] Field of Search ..... 403/297, 290, 409.1; 101/28, 377, 390–394; 29/467, 464

[56] References Cited

U.S. PATENT DOCUMENTS

| | | | |
|---|---|---|---|
| 1,071,215 | 8/1913 | Deckard | 101/383 |
| 1,167,084 | 1/1916 | Leethem | 101/390 |
| 1,196,489 | 8/1916 | Steiniger et al. | 101/383 X |
| 1,486,422 | 3/1924 | Enstrom et al. | 101/394 |
| 1,681,701 | 8/1928 | Gayman | 101/393 |
| 1,714,976 | 5/1929 | Fitzgerald | 101/394 |
| 1,761,979 | 6/1930 | Bowzer | 101/394 |
| 1,938,359 | 12/1933 | Smith | 101/394 |
| 1,999,776 | 4/1935 | Nelson | 101/383 |
| 2,147,433 | 2/1939 | Fyler | 101/394 |
| 2,818,019 | 12/1957 | Goodloe | 101/391 |
| 3,141,406 | 7/1964 | Weinland | 101/390 |
| 4,341,008 | 7/1982 | Graboyes et al. | 29/467 |
| 4,354,770 | 10/1982 | Block | 403/409.1 |
| 4,380,405 | 4/1983 | Kaneki et al. | 403/409.1 X |
| 4,537,124 | 8/1985 | Graboyes | 101/394 X |

*Primary Examiner*—Randolph A. Reese
*Assistant Examiner*—Heather Chun
*Attorney, Agent, or Firm*—James D. Hall

[57] ABSTRACT

A die carrier combined with a die board where the die carrier is positioned within an opening formed in the die board. The die carrier includes a block having a peripheral groove, an extendable strip fitted within the groove, and a screen carried by the block and engageable with the extendable strip to move the strip outwardly from the block. By virtue of the movement of the block within the die board opening, the die carrier may be positioned to register the embossing components.

2 Claims, 2 Drawing Sheets

MEANS FOR MOUNTING AN ADJUSTABLE EMBOSSING DIE

BACKGROUND AND SUMMARY OF THE INVENTION

This invention relates to means for mountng an insert, more particularly an embossing insert, and its corresponding intaglio, to a cutting and scoring die and its counterplate and more specifically to a means for adjustably mounting said insert.

The use of a cutting and scoring die and its corresponding counterplate for the production of objects such as boxes is relatively common and well developed in the art. Such devices and methods are fully described in U.S. Pat. Nos. 4,341,008 and 4,249,432 and others owned by the assignee of the present invention.

In some instances, such as for cigarette boxes, candy boxes, or gift boxes and the like, it is desired to emboss the brand name, or the store or some other decorative design or logo upon the box. In such instances, embossing dies are combined with the cutting and scoring dies.

For purposes of identification, embossing is generally defined as the application of ornamentation to a surface with raised work, or to raise in relief from a surface. The surface is ususally raised by use of an embosser. Corresponding to and cooperating with the embosser is an intaglio, which has the corresponding design depressed below its surface. An intaglio is sometimes referred to as a countersunk die.

Generally speaking, the ruled dies are made of wood and have the cutting and scoring knives embedded therein. The counterplates are made of metal and contain grooves corresponding with the location of the scoring knives. The details of the structure of these dies and counterplates do not necessarily form a part of this invention, are fully described in the previously cited patents, and will not be described in detailed here. The embossing die of this invention is mounted within the cutting die in order that the cutting, scoring, and embossing operations may be performed simultaneously. This has been accomplished previously, e.g., as described in U.S. Pat. No. 4,537,124, and others.

Accuracy in alignment of the embossing dies is extremely critical, in order to prevent a "fuzzy" image or a "double" image affect. Prior art devices have been found lacking in accuracy or are very complicated in their adjustment feature. One such prior art device incorporates a separate frame member which itself nust be inserted into the openings in the steel rule die. However, the space taken up by the frame also places a restriction on the size and positioning of the embossing. In other words, there is a limitation regarding how close the embossing may be located relative to an edge or a corner of the manufactured box.

With the current invention, the embossing die may even be set directly against a steel rule and not only permits close proximity of the embossing to an edge, but also serves to anchor the rule in place.

Accordingly, it is an object of this invention to provide a novel and useful embossing system for a steel rule die and counterplate.

Another object of this invention is to provide a mounting which is more adjustable.

It is a further object of this invention to provide an embossing die carrier which is self-contained.

Other objects of this invention will become apparent upon consideration of the detailed description of one embodiment of the present invention.

BRIEF DESCRIPTION OF THE DRAWINGS

The present invention is illustrated hereinafter by a detailed description of the preferred embodiment, which is presented in conjunction with, and by reference to, the accompanying drawings, in which like reference characters refer to like or corresponding parts, and wherein.

DETAILED DESCRIPTION OF THE PREFERRED EMBODIMENT

The preferred embodiment illustrated is not intended to be exhaustive or to limit the invention to the precise form disclosed. It has been chosen and is herein described in order to best explain the invention and its practical use to enable others skilled in the art to best utilize the invention.

In order to eliminate unnecessary descriptive material and to focus on the invention, the structure and utilization of cutting and scoring dies and their counterplates will not be described in detail.

Also, because of the many variations which may be incorporated into a given embossing die, and further considering the fact that the embossing die per se does not consititute the invention, the embossing die itself will not be illustrated other than in general broad terms, it being understood that such embossing die is secured by any number of different ways to the outer face of the die carrier.

Figure 1:
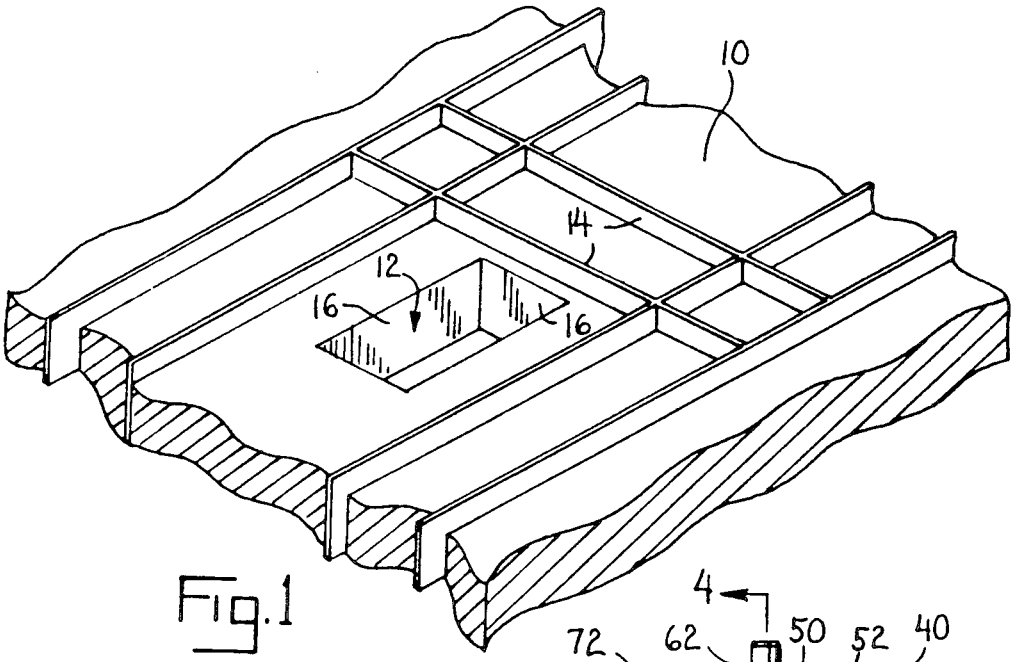
FIG. 1 is a fragmentary perspective view of a cutting and scoring rule die, provided with an aperture for receiving the die carrier of this invention.
Figure 2:
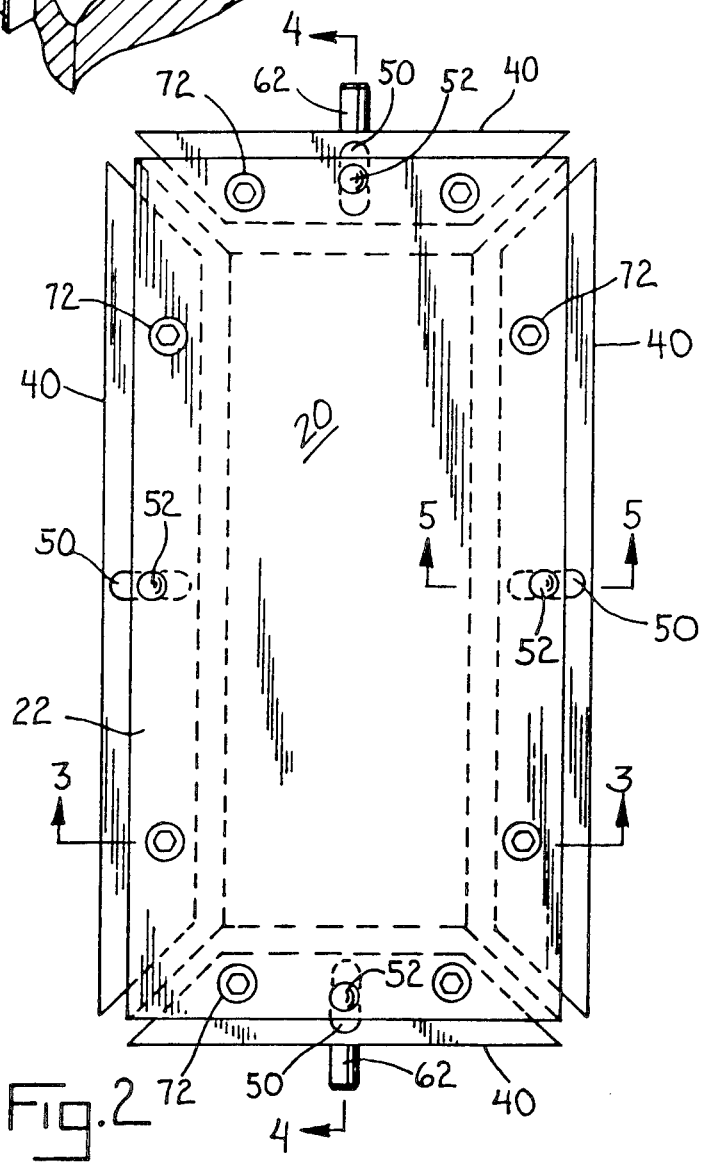
FIG. 2 is a plan view of the die carrier of this invention.

A fragmentary sectional view of a die board, shown here as a steel rule die 10, is illustrated in FIG. 1. Steel rule die 10 is provided with aperture 12, the size and shape thereof being restricted only in that it fit within the boundaries formed by scoring rules 14.

Die carrier 20 is shaped to fit aperture 12 with a minimum of clearance. Die carrier 20 includes mounting block 22 and four peripherally extendable cam parts or strips, all of which, because length and shape are not necessarily a limitation, will be referred to by the numeral 40. It will be noted at this juncture that, if block 22 were circular, trapezoidal, oval, etc., strips 40 would be curved or shaped to conform to such a configuration without departing from the invention.

Around the outer circumference or peripheral edge of block 22 is machined or formed an inwardly extending, wedge or triangle-shaped groove 30. Groove 30 is essentially the shape of an equilateral right triangle, the bottom surface 32 thereof being horizontal, or parallel, to lower surface 26 of block 22, upper surface 34 extending inwardly from a point near upper surface 28 of block 22 at a 45° angle to a point 36 where the surfaces meet. Point 36, however, is not a sharp intersection, but a blunt edge.

Strips 40 generally extend about the entire periphery of block 22 and are of a shape complementary to groove 30. That is to say, strips 40 have surface 42, parallel to bottom surface 32 of groove 30, and upper surface 44, parallel to upper surface 34 of groove 30. However, since strips 40 are solid, they also have a vertical face 48, which will be further explained henceforth.

Figure 5:
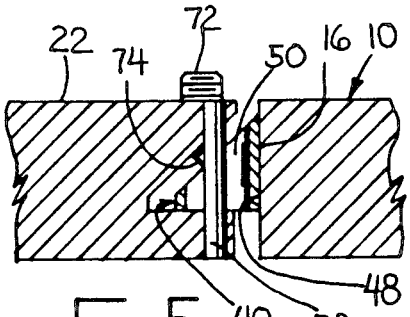
FIG. 5 is a fragmentary cross-sectional view taken along line 5—5 of FIG. 2.

At approximately the midpoint of each strip 40 (as illustrated) there is a bored vertical slot 50, the purpose of which is to accommodate vertical pins 52, which extend through bores 54, themselves vertically extending through block 22 and within groove 30 (best shown in FIG. 5).

Figure 4:
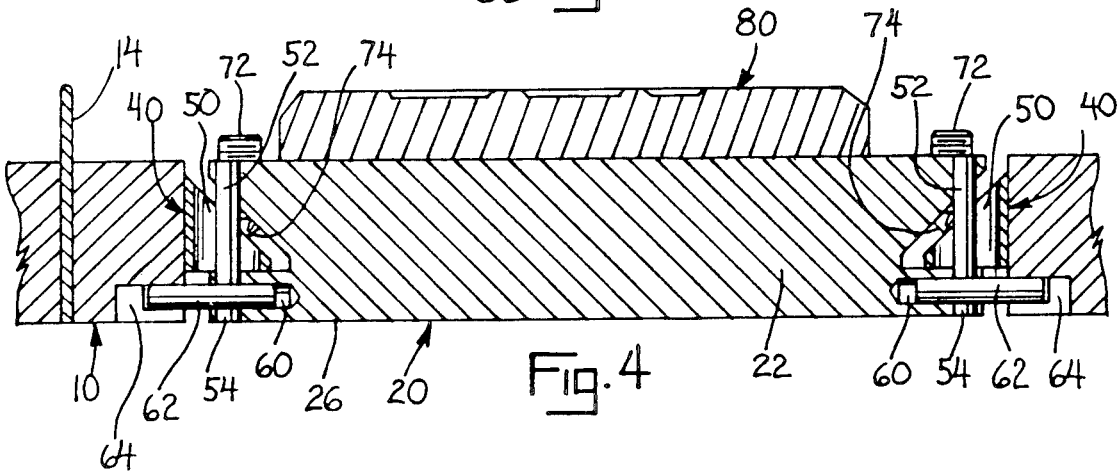
FIG. 4 is a fragmentary cross-sectional view taken along line 4—4 of FIG. 2; but further illustrating the placement of an embossing die.

Die carrier 20 is illustrated as having a rectangular shape. Vertical slots 50 and pins 52 are, as explained above, shown in four locations. Intermediate each end and coincident with vertical pins 52 are found horizontal pins 62. As best illustrated in FIG. 4, horizontal pins 62 extend into bores 60 within block 22 and into notches 64 in steel rule die 10. It will be observed that bores 54 and 60 are in the same plane, intersecting at a point near lower surface 26 of block 22. In practice, at these points of intersection, horizontal pins 62 are first inserted and then shorter vertical pins 52 are inserted. Pins 52 actually rest on pins 62, although bores 54 extend through block 22. Pins 52 merely hold die carrier 20 together during handling and insertion into aperture 12 of die 10 and do not come into play during the cutting, scoring and embossing operation. In operation, die 10 and block 22 sit upon the bolster plate or platen (not shown) of the press.

Figure 3:
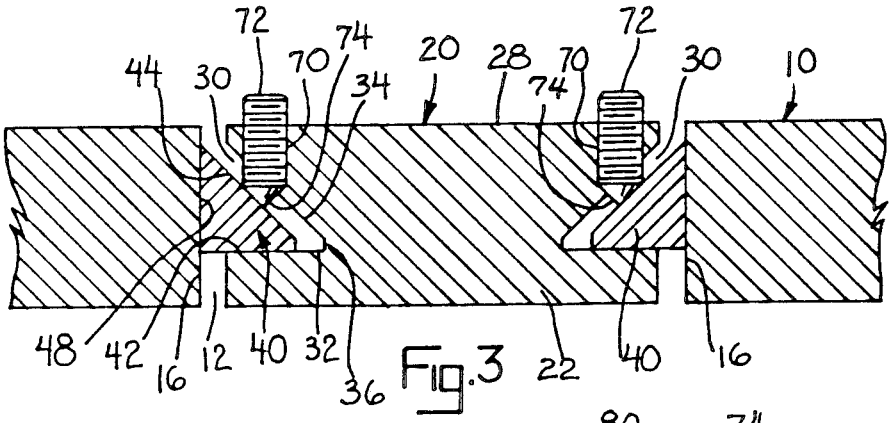
FIG. 3 is a fragmentary cross-sectional view taken along line 3—3 of FIG. 2.

The carrier adjustment of this invention operate in conjunction with strips 40. In the preferred embodiment illustrated, die carrier 20 is, as previously mentioned, of a rectangular shape. Strips 40 extend the length and width of block 22, and are held loosely together therewith by pins 52 which extend with substantial clearance through slots 50 in the block. Threaded holes 70 are bored through block 22, in such a position as to extend into groove 30. Two or more holes may be bored on each side of block 22. Set screws 72 are inserted into threaded holes 70, as best illustrated in FIG. 3. The lowermost portions, or tips 74 of set screws 72 are machined to a 45° angle, matching the angle of upper surface 44 of strip 40.

Pressure applied to set screw 72 forces strip 40 downwardly against surface 32 of groove 30 and outwardly against face 16 of aperture 12 in steel rule die 10. When opposing set screws 72 are tightened, the outward action of strips 40 against faces 16 fixes block 22 into aperture 12. By loosening one set screw 72 and tightening the opposing set screw 72, the position of block 22 within aperture 12 may be adjusted laterally.

As previously mentioned, the embosser per se is an adjunct to, but not a specific part of, the invention. For purposes of illustrating the function of the invention, one half of the embosser, the intaglio 80, is illustrated in FIG. 4. Intaglio 80 is secured to outer surface 28 of block 22 by any means desired, such as by use of adhesives or screws.

In operation, and merely by way of example, an embossing die is secured to either a counterplate or a cut plate and the intaglio is secured to the die carrier. The die carrier is assembled, that is the strips and pins are joined to the block, and the block is inserted into the corresponding aperture of the steel rule die. The set screws on the die carrier are tightened down. The vertical movement of each set screw is translated into lateral movement of the strips, thereby securing the die carrier within the aperture.

A test paper or sheet of stock may be inserted between the embossing die and intaglio and the embossing step performed. If the embosser is not perfectly aligned, the intaglio may be adjusted by movement of the set screws which cause lateral movement of the die block 22. Thus, perfect registration can be obtained with a minimal amount of adjustment. Even in the midst of a run, if it is noted that the registration is no longer perfect, the intaglio may be easily adjusted with a minimum of loss of time.

It will be understood that the invention is not to be limited to the precise form disclosed in the preferred embodiment or by the terms of the above description, but may be modified without department from the scope of the appended claims.

What is claimed is:

1. In combination, a die board and an adjustable die carrier, said die board having an opening therein, said die carrier fitted into said opening, said die carrier comprising a block having opposite sides each of said sides having a peripheral groove, a cam part fitted in each groove, securement means anchoring each cam part in its said groove for permitting restricted lateral movement of the cam part relative to said block, a threaded bore formed in said die carrier in communication with each groove, an adjustment screw in each threaded bore, the tip of each adjustment screw contacting a said cam part so that movement of said adjustment screw against the cam part cause the cam part to move laterally relative to said block, said opening being defined by opposed faces of said die board, a said cam part in contact with each opening face, whereby said lateral movement of said cam part causes movement of the block relative to the die board.

2. The die board and die carrier of claim 1 wherein each cam part has an opening, said securement means including a pin extending with clearance through said cam part opening and anchored in said block.

* * * * *